US009640195B2

(12) United States Patent
Lepauloux et al.

(10) Patent No.: US 9,640,195 B2
(45) Date of Patent: May 2, 2017

(54) TIME ZERO CONVERGENCE SINGLE MICROPHONE NOISE REDUCTION

(71) Applicant: NXP B.V., Eindhoven (NL)

(72) Inventors: Ludovick Lepauloux, Cannes (FR); Jean-Christophe Dupuy, Mougins (FR); Laurent Pilati, Biot (FR)

(73) Assignee: NXP B.V., Eindhoven (NL)

( * ) Notice: Subject to any disclaimer, the term of this patent is extended or adjusted under 35 U.S.C. 154(b) by 0 days.

(21) Appl. No.: 14/946,316

(22) Filed: Nov. 19, 2015

(65) Prior Publication Data

US 2016/0232915 A1 Aug. 11, 2016

(30) Foreign Application Priority Data

Feb. 11, 2015 (EP) ..... 15290032

(51) Int. Cl.
*G10L 21/02* (2013.01)
*G10L 21/0208* (2013.01)

(52) U.S. Cl.
CPC ..... *G10L 21/0208* (2013.01)

(58) Field of Classification Search
CPC ..... G10L 21/0208
USPC ..... 704/227
See application file for complete search history.

(56) References Cited

U.S. PATENT DOCUMENTS 5,706,395 A 1/1998 Arslan et al.
8,059,905 B1 * 11/2011 Christian ..... G06T 5/002 358/463
2008/0294429 A1 * 11/2008 Su ..... G10L 19/09 704/222
2009/0249942 A1 * 10/2009 Suzuki ..... G06F 17/30743 84/602
2009/0279709 A1 * 11/2009 Asada ..... G10K 11/178 381/71.1
2010/0020980 A1 * 1/2010 Kim ..... G10K 11/175 381/71.1
2011/0125505 A1 * 5/2011 Vaillancourt ..... G10L 19/005 704/500
2011/0293103 A1 * 12/2011 Park ..... G10K 11/1782 381/57
2011/0305345 A1 * 12/2011 Bouchard ..... G10L 21/0208 381/23.1

(Continued)

FOREIGN PATENT DOCUMENTS

WO WO2016034915 A1 3/2016

OTHER PUBLICATIONS

Roma, G. et al. "Recurrence Quantification Analysis Features for Auditory Scene Classification", IEEE AASP Challenge on Detection and Classification of Acoustic Scenes and Events, 2 pgs. (2013).

(Continued)

*Primary Examiner* — Jakieda Jackson
(74) *Attorney, Agent, or Firm* — Sherry W. Schumm

(57) ABSTRACT

Embodiments of the invention include a device for reducing noise. The device may include a storage configured to store noise data; a processor configured to: classify a segment of noise utilizing noise data which was accumulated prior to initiation of a communication session; estimate the segment of noise, utilizing information received from the noise classification; and select a noise profile which accounts for a user's current context based on a context defined by the data which was accumulated prior to initiation of the communication session.

13 Claims, 5 Drawing Sheets

(56) References Cited

U.S. PATENT DOCUMENTS

| | | | | |
|---|---|---|---|---|
| 2012/0237049 | A1* | 9/2012 | Brown | G10K 11/1788 381/71.1 |
| 2013/0007201 | A1* | 1/2013 | Jeffrey | H04M 1/72569 709/217 |
| 2016/0163303 | A1* | 6/2016 | Benattar | G10K 11/175 381/71.11 |

OTHER PUBLICATIONS

Martin, R. Noise Power Spectral Density Estimation Based on Optimal Smoothing and Minimum Statistics, IEEE Transactions on Speech and Audio Processing, vol. 9, No. 5, pp. 504-512 (Jul. 2001).

Cohen, I. Noise Spectrum Estimation in Adverse Environments: Improved Minima Controlled Recursive Averaging , IEEE Trans. on Speech and Audio Processing, vol. 11, No. 5, pp. 466-475 (Sep. 2003).

Gerkmann, T. et al. Noise Power Estimation Based on the Probability of Speech Presence, IEEE Workshop on Application of Signal Processing to Audio and Acoustics, pp. 145-148 (Oct. 2011).

Srinivasan, S. et al. "Speech Enhancement Using A-Priori Information with Classified Noise Codebooks", Signal Processing Conf., pp. 1461-1464 (Sep. 2004).

Rossi, M. et al. "AmbientSense: A Real-Time Ambient Sound Recognition System for Smartphones", IEEE Intl. Conf. on in Pervasive Computing and Communications Workshops pp. 230-235 (Mar. 2013).

Extended European Search Report for EP Patent Appln. No. 15290032.0 (Jul. 20, 2015).

* cited by examiner

TIME ZERO CONVERGENCE SINGLE MICROPHONE NOISE REDUCTION

CROSS-REFERENCE TO RELATED APPLICATIONS

This application claims the priority under 35 U.S.C. §119 of European patent application no. 15290032.0, filed on Feb. 11, 2015, the contents of which are incorporated by reference herein.

TECHNICAL FIELD

Various embodiments disclosed herein relate generally to software, and more specifically to noise reduction methods and devices.

BACKGROUND

Voice communications and playback are frequently disturbed by noise along the tine, as well as in the background of either user.

SUMMARY

A brief summary of various embodiments is presented. Some simplifications and omissions may be made in the following summary, which is intended to highlight and introduce some aspects of the various embodiments, but not to limit the scope of the invention. Detailed descriptions of a preferred embodiment adequate to allow those of ordinary skill in the art to make and use the inventive concepts will follow in later sections.

Various embodiments relate to a noise reduction method performed by a processor, the method including, classifying a segment of noise utilizing sound data which was accumulated prior to initiation of a communication session; estimating the segment of noise, utilizing information received from the noise classification; and selecting a noise profile which accounts for a user's current context based on a context defined by the sound data which was accumulated prior to initiation of the communication session.

Various embodiments are described further including: applying the noise estimate to canceling noise in the communication session.

Various embodiments are described wherein estimating further includes: utilizing an algorithm associated with a context the user is in provided by the information received from the noise classification.

Various embodiments are described further including: audio being gathered for the sound data in always-on-mode regardless of whether the user is in the communication session or not.

Various embodiments are described selecting further including: discarding a noise estimation based on sound data which was accumulated prior to initiation of the communication session, which indicates the user's context has changed.

Various embodiments are described, estimating further including: estimating using minimum statistics when the information received from the noise classification indicates that the noise is in a stationary context.

Various embodiments are described the classifying further including: classifying the segment of noise as an environment in which the user is in.

Various embodiments are described including a device for reducing noise, the device including a storage configured to store sound data; a processor configured to: classify a segment of noise utilizing sound data which was accumulated prior to initiation of a voice call; estimate the segment of noise, utilizing information received from the noise classification; and select a noise profile which accounts for a user's current context as compared to a context defined by the sound data which was accumulated prior to initiation of the voice call.

Various embodiments are described wherein the processor is further configured to: apply the noise estimate to canceling noise in the communication session.

Various embodiments are described wherein the processor is further configured to: estimate utilizing an algorithm associated with a context the user is in provided by the information received from the noise classification.

Various embodiments are described further including: gathering audio for the sound data in always-on-mode regardless of whether the user is in the communication session or not.

Various embodiments are described wherein the processor is further configured to: estimate using minimum statistics when the information received from the noise classification indicates that the noise is in a stationary context.

Various embodiments are described wherein the processor is further configured to: discard a noise estimation based on sound data which was accumulated prior to initiation of the communication session, which indicates the user's context has changed.

Various embodiments are described wherein the processor is further configured to: classify the segment of noise as an environment in which the user is in.

Various embodiments are described include a non-transitory machine-readable storage medium encoded with instructions executable by a processor for performing a noise reduction method, the non-transitory machine-readable storage medium including: instructions for classifying a segment of noise utilizing sound data which was accumulated prior to initiation of a communication session; instructions for estimating the segment of noise, utilizing information received from the noise classification; and instructions for selecting a noise profile which accounts for a user's current context based on a context defined by the sound data which was accumulated prior to initiation of the communication session.

Various embodiments are described further including: applying the noise estimate to canceling noise in the communication session.

Various embodiments are described wherein estimating further includes: utilizing an algorithm associated with a context the user is in provided by the information received from the noise classification.

Various embodiments are described further including: audio being gathered for the sound data in always-on-mode regardless of whether the user is in the communication session or not.

Various embodiments are described estimating further including: estimating using minimum statistics when the information received from the noise classification indicates that the noise is in a stationary context.

Various embodiments are described selecting further including: discarding a noise estimation based on sound data which was accumulated prior to initiation of the communication session, which indicates the user's context has changed.

Various embodiments are described the classifying further including: classifying the segment of noise as an environment in which the user is in.

BRIEF DESCRIPTION OF THE DRAWINGS

In order to better understand various embodiments, reference is made to the accompanying drawings, wherein.

To facilitate understanding, identical reference numerals have been used to designate elements having substantially the same or similar structure or substantially the same or similar function.

DETAILED DESCRIPTION

The description and drawings merely illustrate the principles of the invention. It will thus be appreciated that those skilled in the art will be able to devise various arrangements that, although not explicitly described or shown herein, embody the principles of the invention and are included within its scope. Furthermore, all examples recited herein are principally intended expressly to be only for pedagogical purposes to aid the reader in understanding the principles of the invention and the concepts contributed by the inventor(s) to furthering the art, and are to be construed as being without limitation to such specifically recited examples and conditions. Additionally, the term, "or," as used herein, refers to a non-exclusive or (i.e., and/or), unless otherwise indicated (e.g., "or else" or "or in the alternative"). Also, the various embodiments described herein are not necessarily mutually exclusive, as some embodiments can be combined with one or more other embodiments to form new embodiments.

One issue that frequently occurs during wireless communication is the convergence time of single microphone reduction algorithms. Noise suppression algorithms are frequently initiated during telephone or mobile communications when connected. Often, during a telephone call, for example, as well as before a call is being established, several modules may be established without any prior knowledge of the user's environments. These modules may include, for example, acoustic echo cancellers, noise reduction algorithms and noise suppression modules. Before a noise reduction module may become effective, noise estimators which may be used in noise reduction modules may attempt to converge to the true background noise level in a few seconds in order to be inaudible. Frequently, a slowly decreasing background noise level will be heard by a user. Thus, there exists a need in the art for better noise reduction algorithms as well as to accumulate noise data which occurs prior to when the algorithm is used.

In certain embodiments, the system may create and perform noise classifications in a noise classification module. Further, after processing in the noise classification module, a noise estimation module may compare noise correction and cancellation algorithms which may be appropriate for the relevant classified determined noise type. Finally, a noise estimate selection module may then utilize different selection schemes to determine which noise estimation mechanism to use and a final decision is made. Data tables may be used in this component. Next, the estimation type and estimation selections may be provided to a noise suppression module which may perform the noise suppression along with an acoustic echo cancellation module.

Figure 1:
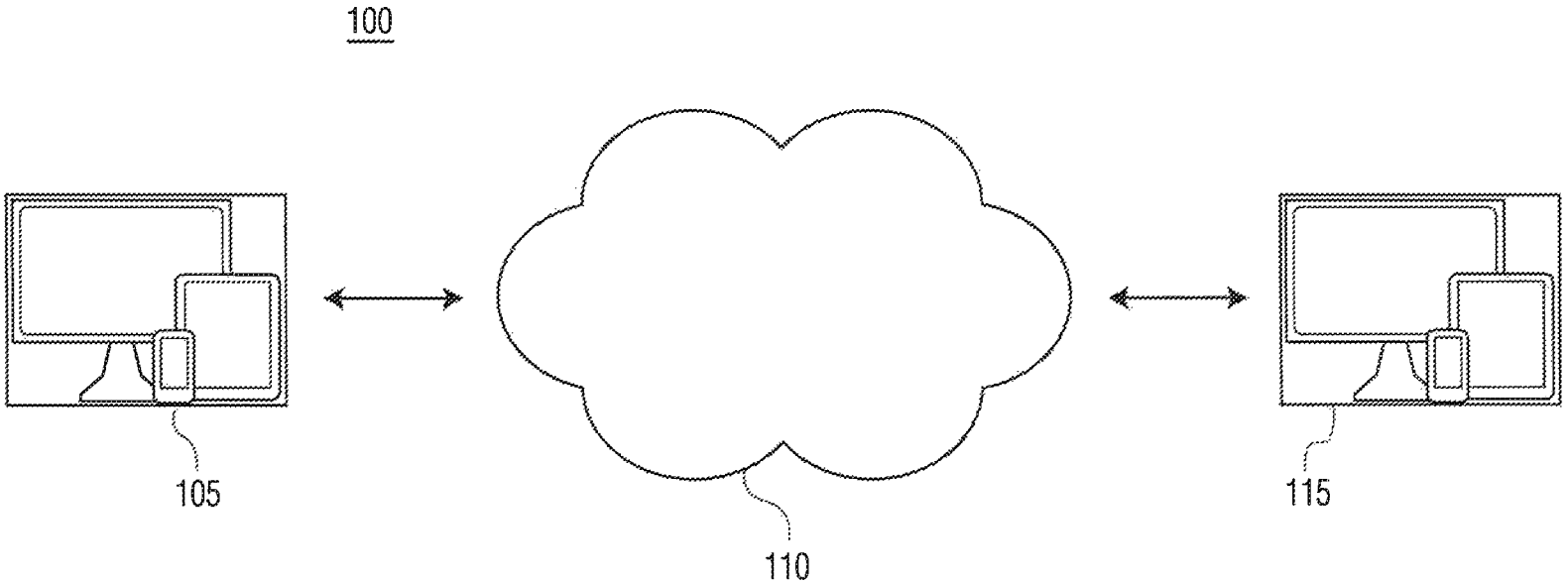
FIG. 1 illustrates a user environment.

FIG. 1 illustrates a user environment 100. The user environment may include user equipment 105 connected through network 110 to user equipment 115.

Network 110 may be a subscriber network for providing various services. In various embodiments, network 110 may be a public land mobile network (PLMN). Network 100 may be telecommunications network or other network for providing access to various services. For example, network 100 may be a Personal Area Network (PAN), a Local Area. Network (LAN), a Metropolitan Area Network (MAN), or a Wide Area Network (WAN). Similarly, network 100 may utilize any type of communications network protocols such as 4G, 4G Long Term :Evolution (LTE), Code Division Multiple Access (CDMA), Global System for Mobile Communications (GSM), Voice Over IP (VoIP), or Transmission Control Protocol/Internet Protocol (TCP/IP).

User equipment 105 or 115 may be a device that communicates with network 110 for providing the end-user with a data service. Such data service may include, for example, voice communication, text messaging, multimedia streaming, and Internet access. More specifically, in various embodiments, user equipment 105 or 115 is a personal or laptop computer, wireless email device, cell phone, tablet, television set-top box, or any other device capable of communicating with other devices. In some embodiments user equipment 105 may communicate with user equipment 115 as a communication session. A communication session may include, for example, a voice call, a video call, a video conference, a VoIP call, and a data communication.

User equipment 105 and 115 may contain listening, recording and playback devices. For example, user equipment 105, 115 may contain a microphone, an integrated microphone or multiple microphones. Similarly, user equipment 105, 115 may have one or more speakers as well as different kinds of speakers such as integrated or embedded.

Figure 2:
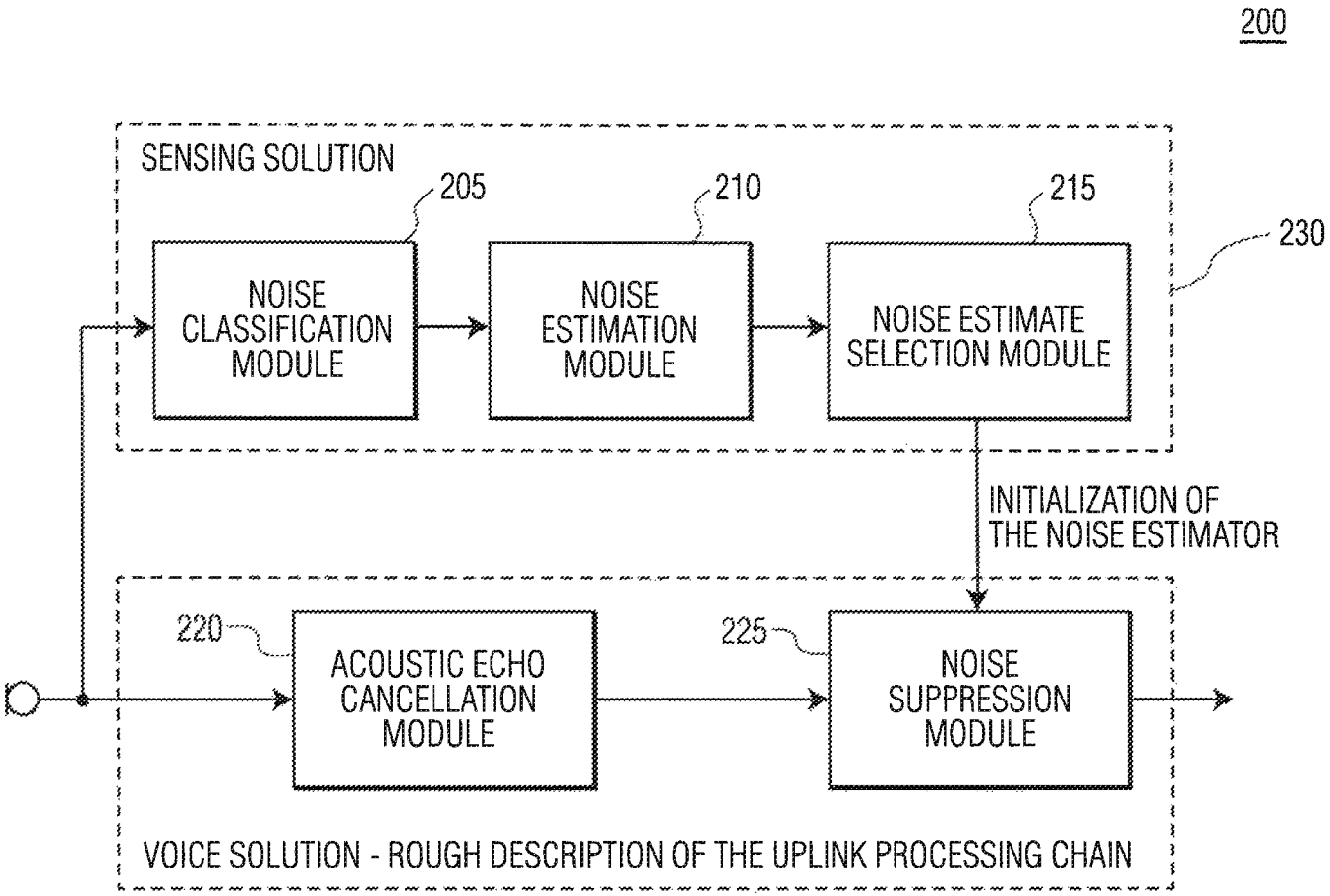
FIG. 2 illustrates a block diagram of a noise suppression system.

FIG. 2 illustrates an embodiment of a noise suppression system 200. One embodiment of a noise suppression system 200 may include sensing solution 230, which includes noise classification module 205, and noise estimation module 210, noise estimation selection module 215, acoustic echo cancellation module 220, and noise suppression module 225. Implementation of one embodiment of a noise suppression system 200 may be directed toward solving the convergence time issue of noise reduction algorithms. In certain embodiments mobile devices such as a phone, phablet or tablet may be used.

The noise classification module 205 may utilize any sound or noise recognition and classification algorithm to classify noise sensed in user equipment 105. Some examples of algorithms include: Gaussian mixture models (GMM), neural networks (NN), deep neural networks (DNN), GMM with hidden Markov models (HMM), a Viterbi algorithm, support vector machines (SVM), and supervised or unsupervised approaches. Noise classification module 205 may be run in always-on mode. Noise classification module may be performed on a Microcontroller unit (MCU) of a device.

In one embodiment, classification of background noise which may describe the user environment may utilize machine learning (ML) algorithms. When supervised learning, ML algorithm are used, features in the data may be utilized and/or identified, to create a prediction model which may be used to classify sound picked up by a microphone. Therefore, relevant features on a microphone's signal may be computed and a model built of different background noise sources. The model's data may be passed on to a classification algorithm. In another embodiment, unsupervised learning without a model may be utilized.

Features which may be extracted from a microphone's signal include, for example, Mel Frequency Cesptral Coefficients (MFCC) and their derivatives Delta-MFCC and Delta-Delta-MFCC. The MFCC extracted features may be used for both characterizing noisy signal as well as speech signals.

To take temporal information into account, additional features may also be computed using recurrence quantification analysis (RQA) such as in Gerard Roma, Waldo Nogueira and Perfecto Herrera, Recurrence quantification analysis features for auditory scene classification, IEEE AASP Challenge on Detection and Classification of Acoustic Scenes and Events, 2013, incorporated herein by reference. Both temporal and frequency signatures of background noise sources may be captured. A person having ordinary skill in the art would easily recognize that any of several other features may be used.

Any of several classification algorithms may be used. In one example, classification based on a model built with features extracted from a microphone's signal may be performed by support vector machines (SVM). A model of the background noises to be recognized and/or obtained which may be based on a training data set may be given to the SVM classifier running in 'always-on' mode. The microphone signal, therefore, may be continuously classified, The noise classification module may output the user context every few seconds, by indicating car, restaurant, subway, home, street, office, for example.

In noise estimation module 210, a hardware or software Digital Signal Processor (DSP) may be used to estimate noise and noise data received from noise classification module 205. Noise classification module 205 may provide audio context recognition. Noise estimation in noise estimation module 210 may be driven by using the most appropriate noise estimator which corresponds to the noise context and/or data. Contexts may be stationary, or non-stationary, for example, signaling different noise estimators. In one embodiment Bayesian approaches may be utilized. In another embodiment, non-Bayesian approaches may similarly be utilized.

In some embodiments, appropriate estimations may be used which are known for stationary noise. For example, noise estimation based on minimum statistics may be used for stationary noise sources such as car noise. A method of minimum statistics noise estimation is described in, Rainer Martin, Noise power spectral density estimation based on optimal smoothing and minimum statistics, IEEE Transactions on Speech and Audio Processing, 2001, and is incorporated by reference.

In some embodiments, changing environments which may include non-stationary noise may use different estimations techniques. One technique which may be used for adverse noise conditions includes that described in Israel Cohen. Noise spectrum estimation in adverse environments: improved minima controlled recursive averaging, IEEE Transactions on Speech and Audio Processing, vol. 11, 2003 and is incorporated herein by reference. In another embodiment a noise estimation technique taught in Timo Gerkmann and Richard C. Hendriks, Noise power estimation based on the probability of speech presence, IEEE Workshop on Application of Signal Processing to Audio and Acoustics, 2011, incorporated herein by reference, may be used for non-stationary noise. Non-stationary noise estimators may be used for non-stationary noise sources such as Minimum Mean Square Error (MMSE), Short Time Spectral Amplitude (STSA), Improved Minima Controlled Recursive Averaging (IMCRA) and data driven recursive noise power estimation. Similarly any kind of noise estimators may be able to track impulsive noises. Estimating a segment of noise by noise estimation module 210 may occur by any kind of noise data manipulations such as those mentioned above. A noise segment which may be provided by noise classification module 205 may indicate a certain period of time or duration of the noise and/or sound which is incoming. Thus, the estimating of the noise or sound may include multiple and a variety of types of data and sound segment manipulations.

Noise estimation may be switched or chosen in noise estimation module 210 as appropriate for each context and/or user environment. A smoothing procedure may be performed by noise estimation module 210 before forwarding on to noise estimate selection module 215 to ensure no clicking, for example, which may occur by an abrupt change in a user's environment.

Noise estimation selection module 215 may receive noise estimation data from noise estimation module 210. Noise estimation selection module 215 may select the noise estimation model to use based on any type of selection criteria. For example, noise estimation selection module 215 may utilize a voting mechanism, weighted decision mechanism, tables, final decisions, modeling, etc.

As a user may go freely to different locations over the course of a day, OF an hour it may be difficult to predict when noise estimation may be turned on or desired. For example, in the case of a telephone call, most telephone calls will be at random times and there will be no way to identify when a noise reduction algorithm will be desired. Further, where a user or a device may be, is similarly hard to predict. For example, a device may be in the pocket of a user, on a table, in a car kit, restaurant, home, outside, etc. Noise estimation selection module 215 may be used to discard noise estimates not aligned with the noise conditions fitting with the true or current user environment. For example, when a phone is in use. For example, noise picked-up by the microphone when the mobile goes from the pocket or the bag of the user to his/her ear may be discarded. In some embodiments, a voice call may switch from handset to hands free or hands free to handset modes during a phone call or communication and noise estimation and classification may occur at any time during or between.

A selection mechanism may be based on consideration of time or quality. For example, the latest noise estimate may be one chosen to be provided to noise suppression module 225. Similarly, a voting mechanism may be the method used. In one embodiment, the best past noise estimates may be selected taking into account a user environment and the time stamp of a noise estimate with respect to the time of the voice call. The noise estimation selection module 215 may pass accurate and up-to-date noise estimates to the noise suppression module 225.

Noise estimate selection module 215 may provide to noise suppression module 225 what noise type to suppress. Similarly, noise suppression module 225 may communicate with acoustic echo cancellation module 220 ensuring the actual noise cancellation is occurring according to the noise selections done by sensing solution 230, Acoustic echo cancellation module 220 may include any kind of hardware or software noise cancellations systems or methods typically used to cancel echo.

Figure 3:
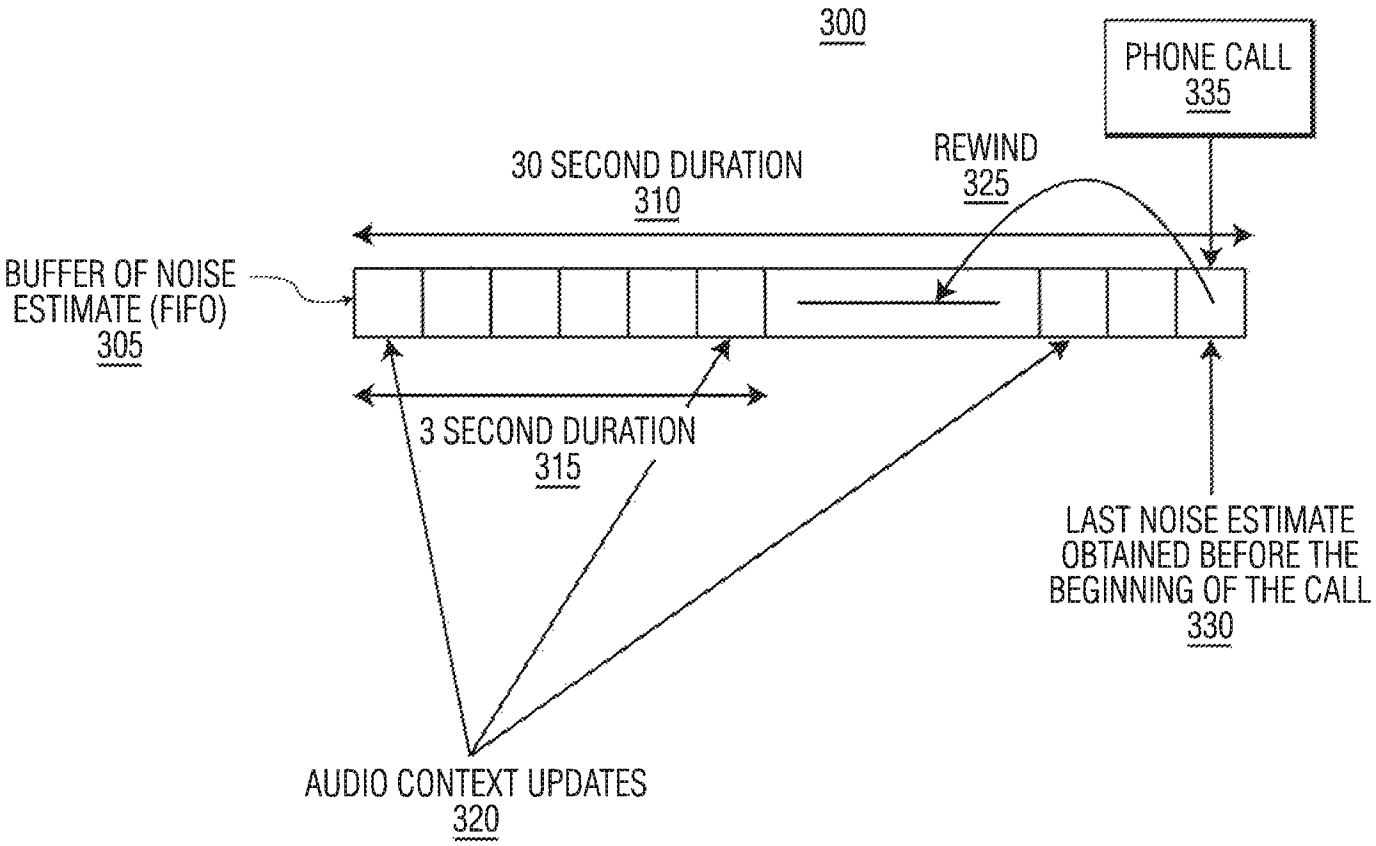
FIG. 3 illustrates a time stamp mechanism.

FIG. 3 illustrates a time stamp mechanism 300. Time stamp mechanism 300 may include buffer of noise estimate 305, 30 second duration 310, 3 second duration 315, audio context updates 320, rewind 325, last noise estimate obtained before the beginning of the call 330 and phone call 335.

In time stamp mechanism 300 each noise estimate may receive a time stamp such as in time slots audio context updates 320. In time stamp mechanism 300 each audio context updates 320 time slots are 0.5 seconds long. Six slots make up 3 second duration 315 in this example. Buffer of noise estimate 305 may be made up of any number of noise estimations marked in time slots. For example, 100 ms, 200 ms or even 1 second time slots/sampling periods may be used for noise estimation and classification. In time stamp mechanism 300 buffer of noise estimate 305 is a First In First Out (FIFO) algorithm.

In one embodiment, noise recording may begin at any time after device startup. A phone cal such as phone call 335 may occur after several noise estimates have occurred. Device such as user equipment 105 may begin recording noise upon startup and receive a call at phone call 335. Simultaneous to phone call 335, last noise estimate obtained before the beginning of the call 330 may be recorded and marked with a time stamp. Upon receipt of the call, sensing solution 230 may use rewind 325 to go back any amount of time and begin using noise estimation data. A rewind 325 may, for example, go back to a point where the current noise type (for example, in a car, in a restaurant, outside, in a home, walking) began and utilize that data for noise canceling. Therefore, before any noise cancellation procedure begins prior time noise estimations may be retrieved. In one example, a noise estimate computed six seconds ago may be retrieved when no major change has occurred in the environment.

In some examples, predictive techniques may be used related to possible variations in the noise estimate knowing the user environment. For example, if a user is in a car, wind noise or outside noise which may occur upon leaving the vehicle may be used to speed up and prepare estimation mechanisms.

For example, if a user takes a call in their car once they are parked and exits the car, an abrupt change may occur in noise conditions and this may be tracked. Accurate tracking may occur to provide good noise estimates to the noise suppression module 225. Therefore, different statistics may be used for different classifications and noise types as well as changing or predictable environment alterations.

Figure 4:
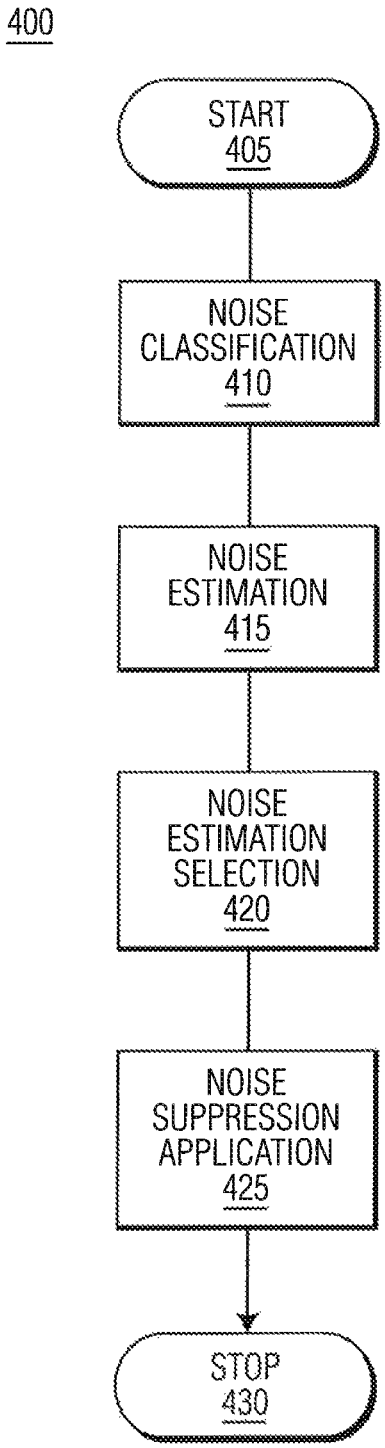
FIG. 4 illustrates a method for noise estimation.

FIG. 4 illustrates a method for noise estimation 400. User equipment 105 or user equipment 115, for example, may implement the method for noise estimation 400. User equipment 105 may begin in step 405 and proceed to step 410 where it may perform noise classification.

In step 410, noise classification may occur via any of the methods discussed regarding noise classification module 205. In step 410, the noise classification module 205 may utilize any sound or noise recognition and classification algorithm. Examples of algorithms may include GMM, NN, DNN, HMM, and SVM. Noise classification module 205 may be run in always-on mode. Noise classification module may be performed on a Microcontroller Unit (MCU) of a device. Any of several classification algorithms may be used. In one example, classification based on a model built with features extracted from a microphone's signal may be performed by SVM. A model of the background noises to be recognized and/or obtained which may be based on a training data set may be given to the SVM classifier running in 'always-on' mode. The microphone signal, therefore, may be continuously classified. The noise classification module may output the user context every few seconds, by indicating car, restaurant, subway, home, street, office, for example.

User equipment 105 may proceed to step 415 where it may perform noise estimation. Noise estimation may occur via any of the methods discussed regarding noise estimation module 210. In step 415 a hardware or software Digital Signal Processor (DSP) may be used to estimate noise and noise data received from noise classification module 205. Noise classification module 205 may provide audio context recognition. Noise estimation in noise estimation module 210 may be driven by using the most appropriate noise estimator which corresponds to the noise context and/or data. Contexts may be stationary or non-stationary, for example, signaling different noise estimators. Bayesian and/or non-Bayesian approaches may be utilized. Noise estimation may be switched or chosen in noise estimation module 210 as appropriate for each context and/or user environment. A smoothing procedure may be performed by noise estimation module 210 before forwarding on to noise estimate selection module 215 to ensure no clicking, for example, which may occur by an abrupt change in a user's environment. In some embodiments, a communication may switch from handset to hands free or hands free to handset modes initiating various different noise estimation and classification respectively.

User equipment 105 may proceed to step 420 where it may perform noise estimation selection. Noise estimate selection may occur via any of the methods discussed regarding noise estimate selection module 215. Noise estimation selection module 215 may select the noise estimation model to use based on any different type of selection criteria. For example, noise estimation selection module 215 may utilize a voting mechanism, weighted decision mechanism, tables, final decisions, modeling, etc. Noise estimation selection module 215 may be used to discard noise estimates not aligned with the noise conditions fitting with the true user environment, A selection mechanism may be based on consideration of time. Similarly, a voting mechanism may be the method used.

User equipment 105 may proceed to step 425 where it may apply noise suppression, Noise suppression may occur in noise suppression module 225 in conjunction with acoustic echo cancellation module 220. User equipment 105 may proceed to step 430 where it may cease operation.

Figure 5:
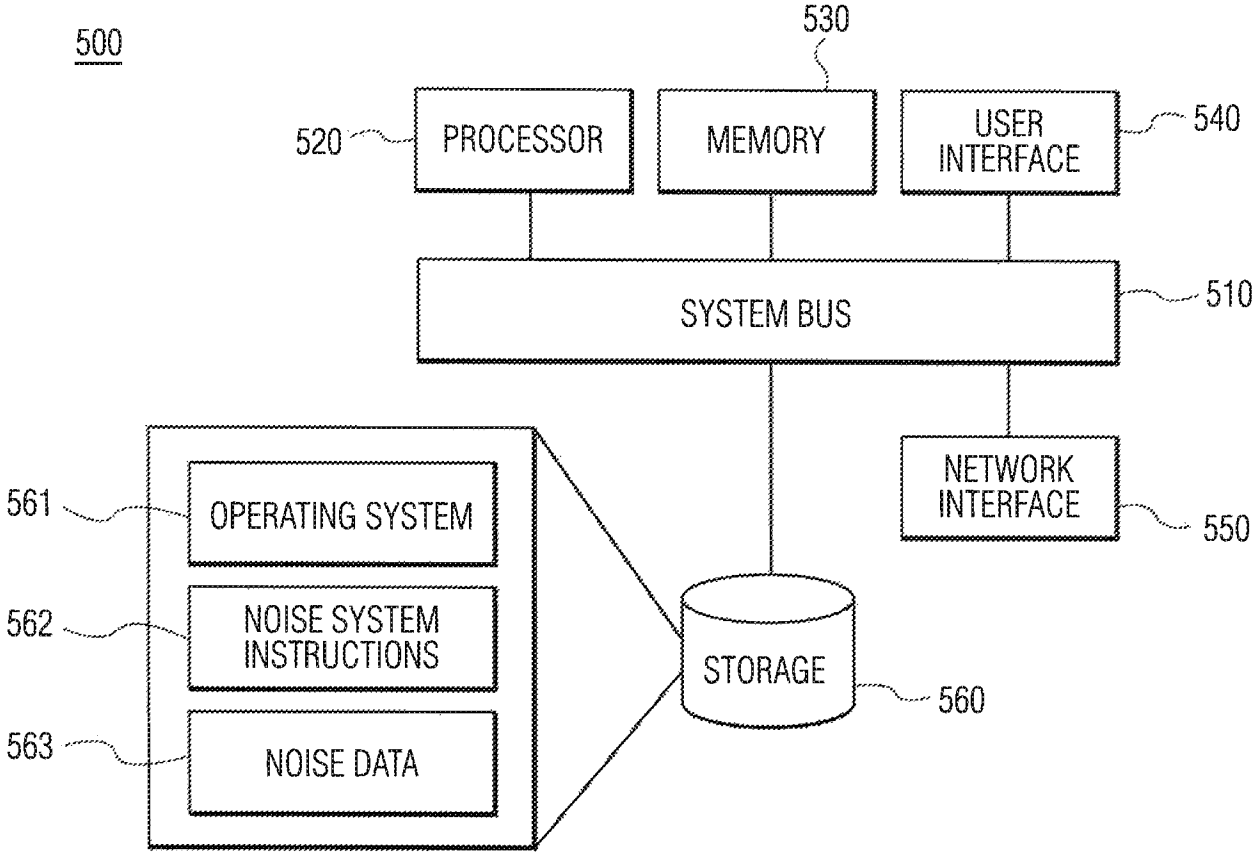
FIG. 5 illustrates a hardware diagram for a device.

FIG. 5 illustrates a hardware diagram for a device 500 such as a mobile phone, personal computer or tablet, The device 500 may correspond to user equipment 105, As shown, the device 500 includes a processor 520, memory 530, user interface 540, network interface 550, and storage 560 interconnected via one or more system buses 510. It will be understood that FIG, 5 constitutes, in some respects, an abstraction and that the actual organization of the components of the device 500 may be more complex than illustrated.

The processor 520 may be any hardware device capable of executing instructions stored in memory 530 or storage 560. As such, the processor may include a microprocessor, field programmable gate array (FPGA), application-specific integrated circuit (ASIC), MCU or other similar devices. Processor 520 may also be a microprocessor and may include any number of sensors used for noise detection and sensing.

The memory 530 may include various memories such as, for example L1, L2, or L3 cache or system memory. As such, the memory 530 may include static random access memory (SRAM), dynamic RAM (DRAM), flash memory, read only memory (ROM), or other similar memory devices.

The user interface 540 may include one or more devices for enabling communication with a user. For example, the user interface 540 may include a display, a touch screen and a keyboard for receiving user commands.

The network interface 550 may include one or more devices for enabling communication with other hardware devices. For example, the network interface 550 may include a mobile processor configured to communicate according to the LTE, GSM, CDMA or VoIP protocols. Additionally, the network interface 550 may implement a TCP/IP stack for communication according to the TCP/IP protocols. Various alternative or additional hardware or configurations for the network interface 550 will be apparent.

The storage 560 may include one or more machine-readable storage media such as read-only memory (ROM), random-access memory (RAM), magnetic disk storage media, optical storage media, flash-memory devices, or similar storage media. In various embodiments, the. storage 560 may store instructions for execution by the processor 520 or data upon which the processor 520 may operate. For example, the storage 560 may store operating system 561 to process the rules engines' instructions. The storage 560 may store noise system instructions 562 for performing noise estimation, classification and suppression according to the concepts described herein. The storage may also store noise data 563 for use by the processor executing the noise system instructions 562.

It should be apparent from the foregoing description that various embodiments of the invention may be implemented in hardware, Furthermore, various embodiments may be implemented as instructions stored on a machine-readable storage medium, which may be read and executed by at least one processor to perform the operations described in detail herein. A machine-readable storage medium may include any mechanism for storing information in a form readable by a machine, such as a personal or laptop computer, a server, or other computing device. Thus, a machine-readable storage medium may include read-only memory (ROM), random-access memory (RAM), magnetic disk storage media, optical storage media, flash-memory devices, and similar storage media.

While the host device 500 is shown as including one of each described component, the various components may be duplicated in various embodiments. For example, the processor 520 may include multiple microprocessors that are configured to independently execute the methods described herein or are configured to perform steps or subroutines of the methods described herein such that the multiple processors cooperate to achieve the functionality described herein.

It should be apparent from the foregoing description that various embodiments of the invention may be implemented in hardware and/or firmware. Furthermore, various embodiments may be implemented as instructions stored on a machine-readable storage medium, which may be read and executed by at least one processor to perform the operations described in detail herein. A machine-readable storage medium may include any mechanism for storing information in a form readable by a machine, such as a personal or laptop computer, a server, or other computing device. Thus, a machine-readable storage medium may include read-only memory (ROM), random-access memory (RAM), magnetic disk storage media, optical storage media, flash-memory devices, and similar storage media.

It should be appreciated by those skilled in the art that any block diagrams herein represent conceptual views of illustrative circuitry embodying the principals of the invention. Similarly, it will be appreciated that any flow charts, flow diagrams, state transition diagrams, pseudo code, and the like represent various processes which may be substantially represented in machine readable media and so executed by a computer or processor, whether or not such computer or processor is explicitly shown.

Although the various embodiments have been described in detail with particular reference to certain aspects thereof, it should be understood that the invention is capable of other embodiments and its details are capable of modifications in various obvious respects. As is readily apparent to those skilled in the art, variations and modifications can be affected while remaining within the spirit and scope of the invention. Accordingly, the foregoing disclosure, description, and figures are for illustrative purposes only and do not in any way limit the invention, which is defined only by the claims.

The invention claimed is:

1. A device for reducing convergence time of noise suppression by a noise suppression module, configured with circuitry, of the device, the device comprising:

a storage configured to store sound data;

at least one processor configured to:

accumulate sound data in the storage while the noise suppression module is inactive;

classify a segment of noise utilizing the sound data which was accumulated while the noise suppression module is inactive and prior to initiation of a communication session;

estimate the segment of noise, utilizing information received from the noise classification; and select a noise profile which accounts for a user's current context based on a context defined by the estimate of segment noise for the sound data;

activate, in response to initiation of the communication session, the noise suppression module;

provide the selected noise profile to the noise suppression module; and cancel noise in the communication session by applying the noise estimate.

2. The device of claim 1, wherein the processor is further configured to:

estimate utilizing an algorithm associated with a context the user is in provided by the information received from the noise classification.

3. The device of claim 1, wherein the processor is further configured to:

gather audio for the sound data in always-on-mode regardless of whether the user is in the communication session or not.

4. The device of claim 1, wherein the processor is further configured to:

estimate using minimum statistics when the information received from the noise classification indicates that the noise is in a stationary context.

5. The device of claim 1, wherein the processor is further configured to:

discard a noise estimation based on sound data which was accumulated prior to the initiation of the communication session, which indicates the user's context has changed.

6. The device of claim 1, wherein the processor is further configured to:

estimate using Minimum Mean Square Error when the information received from the noise classification indicates that the noise is in a non-stationary context.

7. A non-transitory machine-readable storage medium encoded with instructions executable by a processor for performing a noise reduction method, the non-transitory machine-readable storage medium comprising:

instructions for accumulating sound data in the storage while a noise suppression module is inactive;

instructions for classifying a segment of noise utilizing sound data which was accumulated while the noise suppression module is inactive and prior to initiation of a communication session;

instructions for estimating the segment of noise, utilizing information received from the noise classification;

instructions for selecting a noise profile which accounts for a user's current context based on a context defined by the sound data which was accumulated prior to initiation of the communication session;

instructions for activating, in response to initiation of the communication session, the noise suppression module and providing the selected noise profile to the noise suppression module; and instructions for cancelling noise in the communication session by applying the noise estimate.

8. The non-transitory machine-readable storage medium of claim 7, further comprising:

instructions for applying the noise estimate to canceling noise in the communication session.

9. The non-transitory machine-readable storage medium of claim 7, wherein instructions for estimating further comprises:

instructions for utilizing an algorithm associated with a context the user is in provided by the information received from the noise classification.

10. The non-transitory machine-readable storage medium of claim 7, further comprising:

audio being gathered for the sound data in always-on-mode regardless of whether the user is in the communication session or not.

11. The non-transitory machine-readable storage medium of claim 7, wherein instructions for estimating further comprises:

instructions for estimating using minimum statistics when the information received from the noise classification indicates that the noise is in a stationary context.

12. The non-transitory machine-readable storage medium of claim 7, wherein instructions for selecting further comprises:

instructions for discarding a noise estimation based on sound data which was accumulated prior to initiation of the communication session, which indicates the user's context has changed.

13. The non-transitory machine-readable storage medium of claim 7, wherein instructions for estimating further comprises:

instructions for using Minimum Mean Square Error when the information received from the noise classification indicates that the noise is in a non-stationary context.

* * * * *